United States Patent [19]

Forman

[11] Patent Number: 4,928,614

[45] Date of Patent: May 29, 1990

[54] SUBMERSIBLE OBSERVATION VESSEL

[75] Inventor: Willis R. Forman, San Diego, Calif.

[73] Assignees: Ronald Nilson; Sea View Enterprises, both of St. Clair Shores, Mich. ; a part interest

[21] Appl. No.: 337,179

[22] Filed: Apr. 12, 1989

[51] Int. Cl.[5] ..... B63B 35/72

[52] U.S. Cl. ..... 114/66; 114/314; 114/341

[58] Field of Search ..... 114/312, 314, 316, 320, 114/321, 337, 330–335, 338, 341, 256, 257, 66, 65 R, 313; 104/71; 446/161, 162; 441/135; 405/185

[56] References Cited

U.S. PATENT DOCUMENTS

| | | | |
|---|---|---|---|
| 683,361 | 9/1901 | Watson | 114/66 |
| 3,240,186 | 3/1966 | Dobell | 114/66 |
| 3,613,621 | 10/1971 | McKinley | 114/66 |
| 3,680,515 | 8/1972 | Yoneda | 114/66 |
| 3,895,495 | 7/1975 | Akazaki | 441/135 |
| 4,276,851 | 7/1981 | Coleman | 114/66 |
| 4,423,695 | 1/1984 | Rougerie | 114/66 |
| 4,494,472 | 1/1985 | Rougerie | 114/66 |

*Primary Examiner*—Joseph F. Peter, Jr.
*Assistant Examiner*—Clifford T. Bartz
*Attorney, Agent, or Firm*—Barnes, Kisselle, Raisch, Choate, Whittemore & Hulbert

[57] ABSTRACT

A submersible observation vessel having a transparent acrylic hull. The hull comprises a plurality of transparent acrylic cylinders, a plurality of seals to prevent leakage between the cylinders of the hull, a front hatch hinged on the first seal, and a bulk head having an aft hatch welded to the last seal. An integral cradle supports the vessel when on dry dock and provides a medium for lifting the vessel into and out of the water.

21 Claims, 5 Drawing Sheets

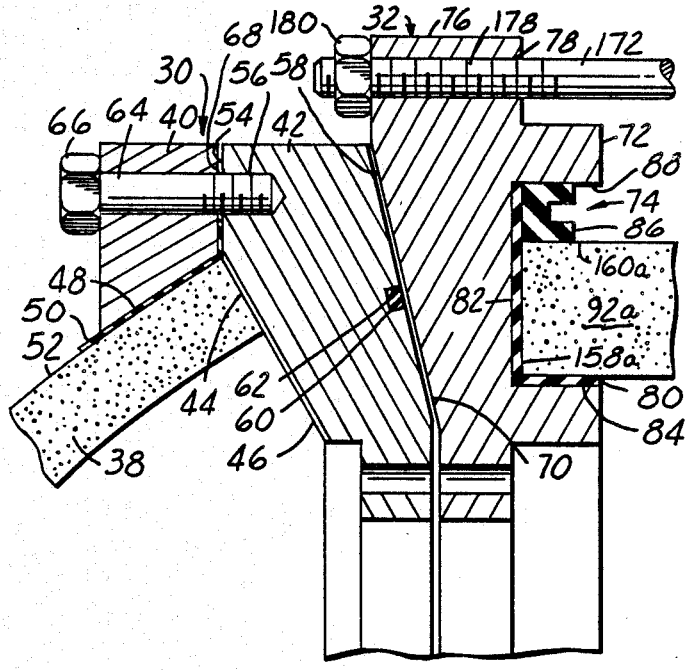
FIG.5
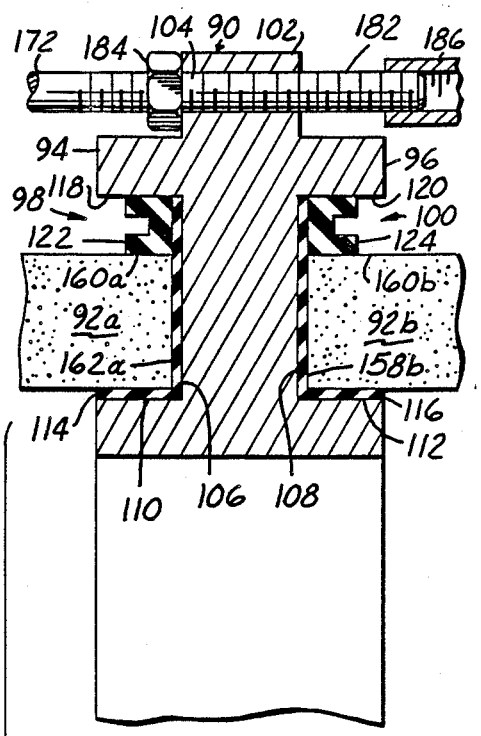
FIG.7
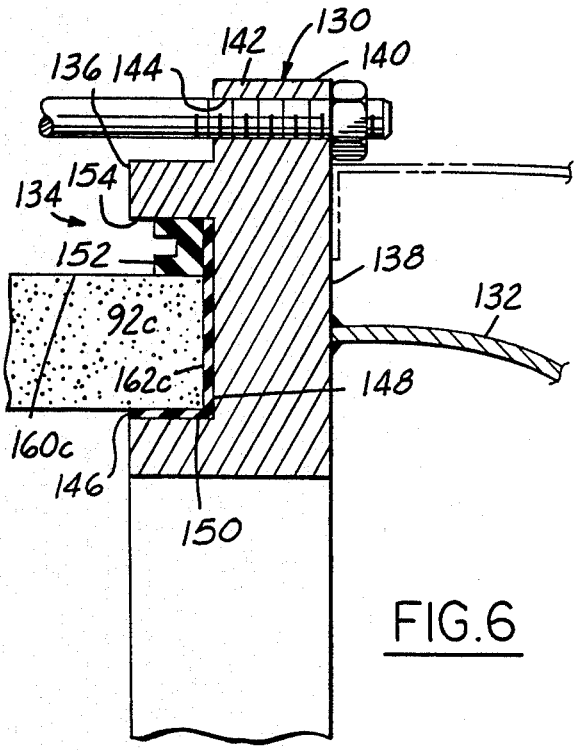
FIG.6
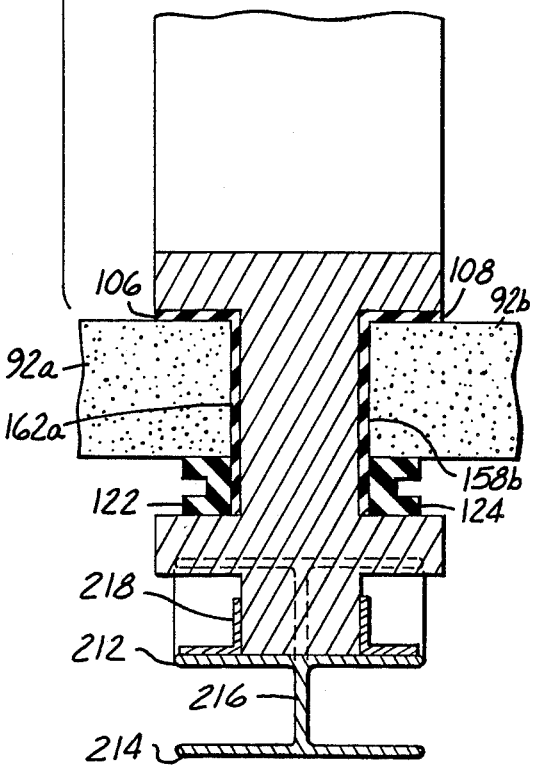

SUBMERSIBLE OBSERVATION VESSEL

FIELD OF INVENTION

This invention relates to a submersible observation vessel, and more particularly a submersible which comprises a transparent acrylic hull having an integral cradle.

BACKGROUND AND SUMMARY OF THE INVENTION

Conventional submersibles are made of 4 inch steel walls which have poor insulation qualities, lack sound absorption properties, and readily condense water on its interior surface. In addition, these submersibles were not designed for sightseeing, but for research, therefore the quarters are uncomfortable and cramped and view ports are small and provide a restricted view of ocean environment. Through these small view ports, a person can sample only a small portion of the beauty of the ocean and its variety of inhabitants.

The purpose of an excursion submersible is to provide every tourist a view of the surrounding ocean in a comfortable manner. Currently a new type of submersible is being designed which features transparent acrylic hulls that can provide a panoramic view of the ocean environment. The acrylic hulls must overcome many hurdles such as being designed to sustain substantial water pressures and meeting or exceeding the rigorous design criteria and regulations dictated by the American Bureau of Shipping. All designs must be reviewed and approved by the American Bureau of Shipping before the submersible can be manufactured.

One design developed by Hyco Technologies of Vancouver, British Columbia, utilizes three acrylic spheres sandwiched in a stainless steel fiberglass framework. The drawbacks of this submersible are (1) a limited passenger occupancy (2) small passageways between acrylic spheres and (3) the cost. Hyco Technologies also has a design for a submersible utilizing acrylic cylinders for a vessel which can accommodate 46 passengers. This design requires the hull be reinforced with wide steel ribs which obstruct and limit the view of the ocean. A further discussion of these designs can be found in the article "Touring the Deep" by Jeff Mangiat, Popular Mechanics, Oct. 1988, beginning at page 68.

An important design criteria for the hull is that the seals properly prevent the passage of water and air into or out of the hull. Another hurdle is that the shape of the hull should be able to provide room, comfort, accessible viewing, and easy ingress and egress for passengers/tourists.

The object of the present invention is to provide a submersible observation vessel that is safe, comfortable and provides a panoramic view of the ocean environment.

It is a feature of this invention to have a transparent acrylic hull for the submersible observation vessel which allows for seated passengers to view the ocean not only laterally out side windows but vertically above their seats through the acrylic hull.

It is another feature of this invention to have seals that meet or exceed the design criteria of the American Bureau of Shipping for providing a water and air-tight hull.

It is another feature of this invention to have a cradle apparatus to support the hull and to provide a means to lift the submersible out of the water.

It is an advantage of this invention to provide an air-tight, water-tight submersible observation vessel having a transparent acrylic hull to transport people, who can not swim or are afraid to dive into deep waters, down into the deep waters to explore the ocean environment.

Other objects, features and advantages of the invention will be apparent in the following description and claims in which the principles of the invention are set forth with details to enable persons skilled in the art to which the invention pertains to practice the invention all in connection with the best mode presently contemplated for the invention.

BRIEF DESCRIPTION OF THE DRAWINGS

Drawings accompany this disclosure and the various views thereof may be described as follows:

FIG. 5 is a fragmentary and enlarged sectional view of a forward hatch and seal of FIG. 4 embodying this invention.

FIG. 6 is a fragmentary and enlarged sectional view of a rear seal of FIG. 4 embodying this invention.

FIG. 7 is an enlarged sectional view of an intermediary seal of FIG. 4 embodying this invention.

DETAILED DESCRIPTION OF PREFERRED EMBODIMENTS

Figure 1:
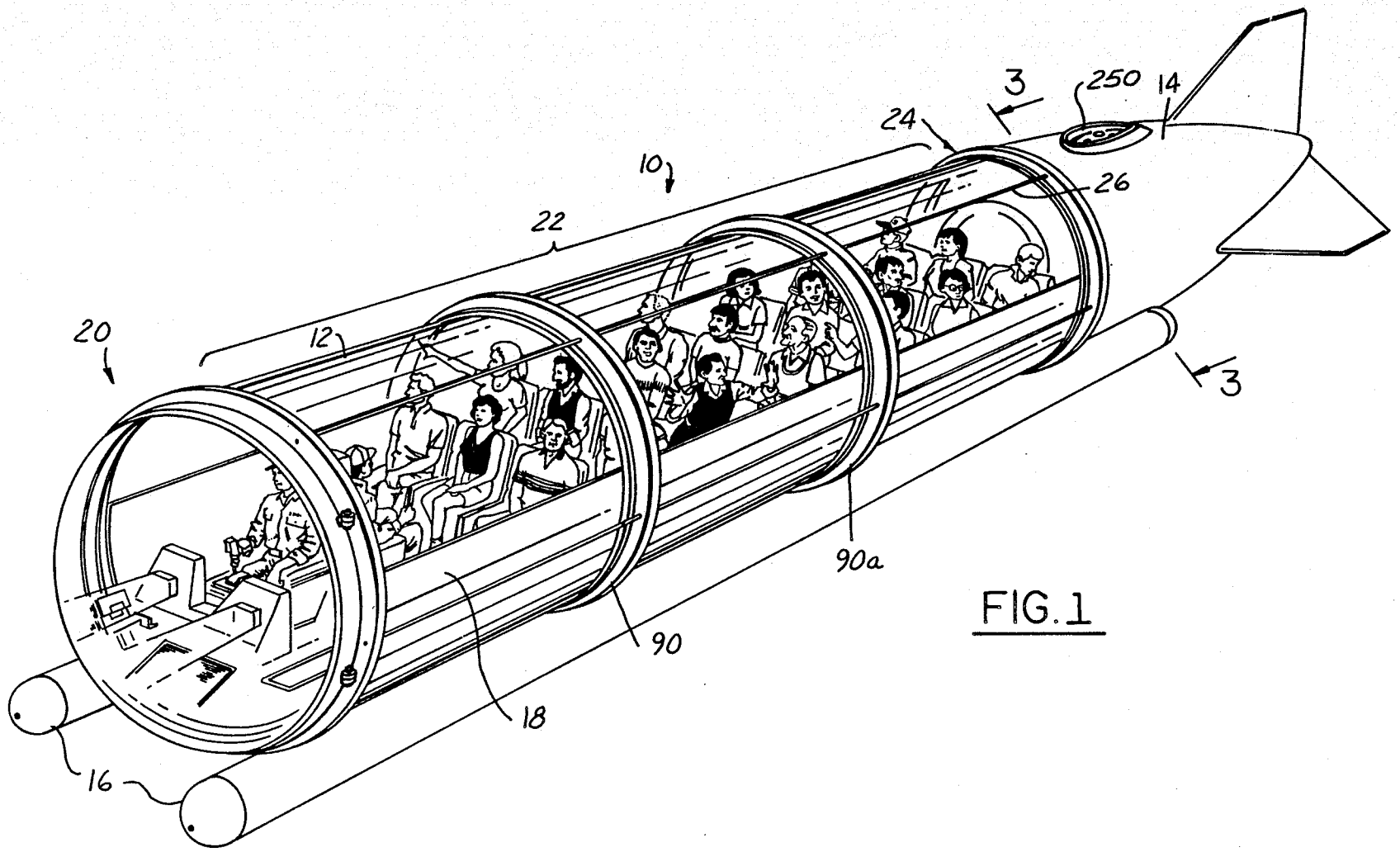
FIG. 1 is a perspective view of a submersible observation vessel having an exemplary but preferred embodiment of a hull of this invention.
Figure 3:
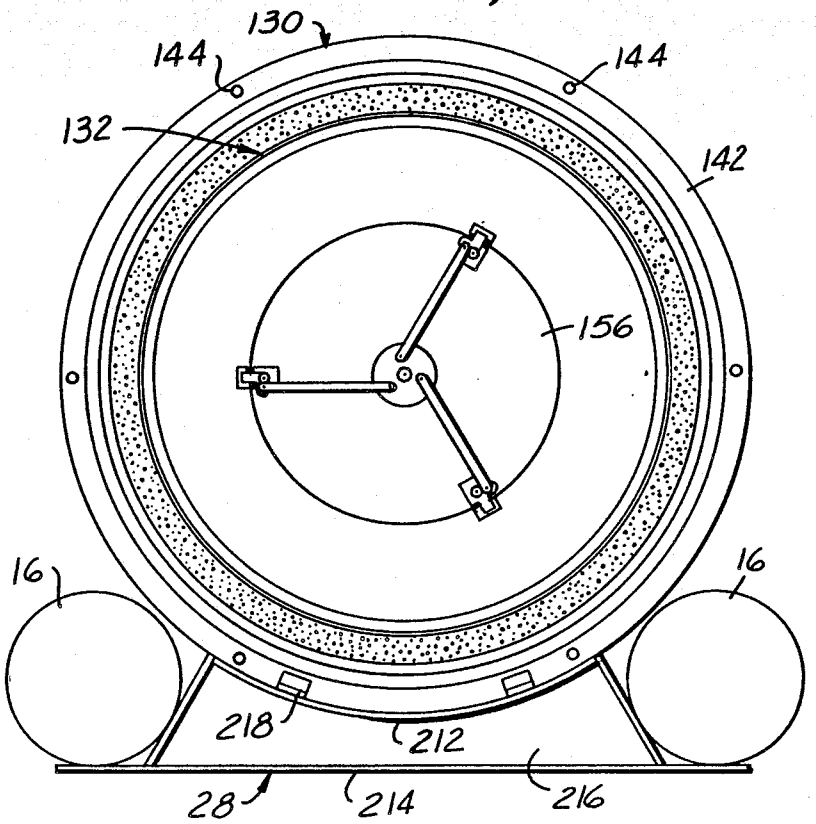
FIG. 3 is a sectional view taken along line 3—3 in FIG. 1.

The preferred embodiment of the present invention is illustrated by way of example in FIGS. 1–9. With reference to FIG. 1, a submersible observation vessel 10 has a transparent hull 12 coupled to an ogive unit 14 and has along the lower portion of the hull a pair of battery pods 16. Attached to the sides of the hull 12 are a pair of propulsion housings 18, which move the vessel through the waters.

Figure 4:
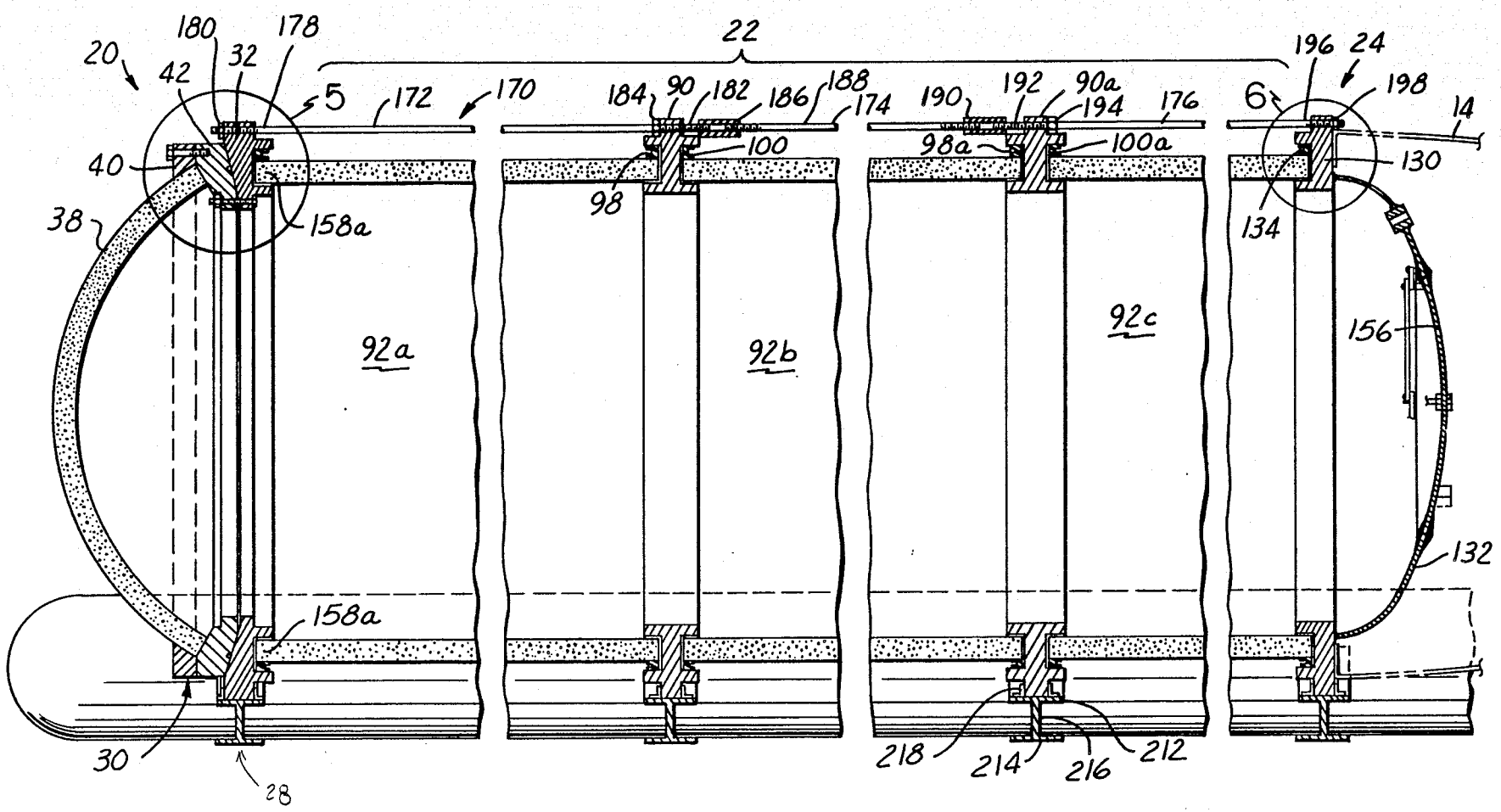
FIG. 4 is a fragmentary side elevational view of the hull of FIG. 1.

The transparent hull 12 has 3 defined areas, forward 20, central 22 and rear 24 sections as shown in FIGS. 1 and 4. A tie-bar unit 26 holds the sections into a water and air-tight hull 12. An integral cradle 28 is fitted to the underside of the hull 12 to provide support for and a medium to lift the hull in and out of the water.

Figure 2:
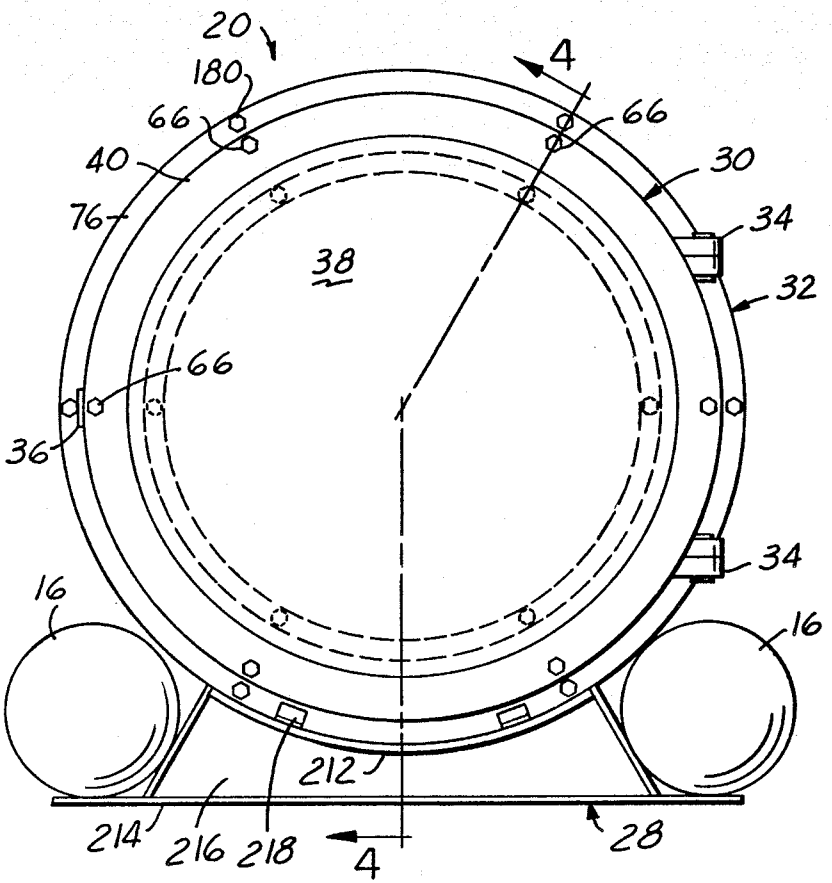
FIG. 2 is an end elevational view of the submersible of FIG. 1 with a front hatch.

As shown in FIG. 2, the forward section 20 of the hull 12 includes a front hatch 30 pivoted on a pair of hinges 34 attached to a first end or forward seal 32. Hatch 30 is held against forward seal 32 by a latch 36, 180° from hinges 34 so that no water may pass between the hatch 30 and seal 32. Front hatch 30 has a generally hemispherical shaped member 38, a holddown ring 40 and a hatch ring 42. Hemispherical shaped member 38 is preferably made of a $3\frac{1}{2}$ inches thick translucent acrylic having a reference radius of 40.1875 inches and an arc of $121\frac{1}{3}°$, which meets or exceeds the minimum physical properties detailed in the ASME/ANSI Specification PVHO-1. The ASME/ANSI Specification is a safety standard for pressure vessels for human occupancy sponsored and published by the American Society of Mechanical Engineers.

To assemble the front hatch 30, acrylic member 38 has its edge 44 abut a lower portion 46 of the forward face of hatch ring 42 as shown in FIG. 5. Hold-down ring 40 goes over hemispherical acrylic member 38 and has its inner circumferential surface 48 pressed down onto a neoprene gasket seal 50 adjoining the entire perimeter portion of outer surface 52 of member 38.

Hatch ring 42 is a circular steel band with threaded bores 56 spaced equally around the perimeter, preferably every 60°, of an upper portion 54 of the hatch ring forward face. Lower portion 46 of the forward face slants inwardly at an angle that allows contact with the entire surface of circumferential edge 44 of hemispherical acrylic member 38. Rear face 58 of hatch ring 42 is beveled slightly with an annular groove 60 midway on face 58 to seat a seal 62 such as an O-ring.

Hold-down ring 40 is a circular band having bores 64 on the perimeter to align with the threaded bores 56 of the hatch ring 42. Hold-down ring 40 has its inner circumferential surface 48 arcuate shaped so that the inner surface 48 can apply a uniform pressure on gasket seal 50 which has conformed its shape to the outer surface 52 of acrylic hemispherical member 38. Bolts 66 are passed through bores 64 of the hold-down ring 40 and are received in threaded bores 56 of hatch ring 42 (FIGS. 2 and 5). As bolts 66 are tightened down, hold-down ring 40 presses against neoprene gasket seal 50 which bears down on hemispherical member 38 to force edge 44 into tight abutment with forward face lower portion 46 of hatch ring 42. Rear face 68 of hold-down ring 40 presses against forward face upper portion 54 of hatch ring 42 with neoprene gasket seal 50 preventing any leakage (FIG. 5). This front hatch 30 acts as both the viewport for the pilot and the front entrance for the vessel.

Forward seal 32 is a circular band having a forward face 70 that is inwardly slanted and clad in monel. A rear face 72 of seal 32 is flat and has an annular groove 74 cut throughout. Forward seal 32 has a shoulder 76 extending radially outward of the forward and rear face. Shoulder 76 has a plurality of through bores 78 preferably spaced every 60° on the periphery. At a plane halfway between the top and bottom of the forward seal 32 is fixedly attached a latch 36 and equally spaced from this plane and opposite the latch 36 are a pair of hinges 34 that support front latch 30. A neoprene bearing gasket 80 lines a bottom wall 82 and inner diameter wall 84 of the annular groove 74 and a neoprene external gasket 86 is adjacent to the outer diameter wall 88 of the annular groove 74.

As shown in FIGS. 1 and 4, the mid-section 22 of the preferred embodiment 10 comprises of a pair of intermediary seals 90, **90*a* and three transparent cylinders 92*a,b,c*. These transparent cylinders 92*a,b,c*** are preferably made up of 3½ inch thick acrylic having an inner diameter of 64½ inches and a length of 90 inches, which exceeds the minimum physical properties ASME/ANSI Specification PVHO-1.

As shown in FIG. 7, intermediary seal 90 is a steel circular band having a flat front and rear face 94, 96 each with an annular groove 98, 100 throughout. This intermediary seal 90 has shoulder 102 between both faces 94, 96. Shoulder 102 has through bores 104 equally spaced, but preferably 60° apart, and in alignment with the forward bores 78. Lining the bottom wall 106, 108 and inner diameter wall 110, 112 of the annular groove 98, 100 is a neoprene bearing gasket 114, 116 and adjoining an outer diameter wall 118, 120 of annular groove 98, 100 is a neoprene external seal 122, 124.

The rear section 24 (FIGS. 3, 4 and 6) includes a second end or rear seal 130 and a bulk head 132. Rear seal 130 is a steel circular band having an annular groove 134 cut in its flat forward face 136 and a rear face 138 perpendicular to the outer circumferential surface 140. Seal 130 has a shoulder 142 radially outward from the front face 136. There are a plurality of bores 144 spaced equally, but preferably 60° about the periphery and through shoulder 142 and in alignment with forward and intermediary seal bores 78, 104. A neoprene bearing gasket 146 lines bottom wall 148 and inner diameter wall 150 of annular groove 134 and a neoprene external seal 152 is adjacent outer diameter wall 154 of annular groove 134. Welded to the flat rear face 138 of rear seal 130 is ellipsoid shaped bulk head 132 having hinged to it an aft hatch 156 for alternate entrance/exit from submersible 10.

To construct hull 12 into an air-tight and water-tight configuration, first cylinder **92*a* has its forward edge 158*a* fitted into annular groove 74 of forward seal 32 and is contiguous with neoprene bearing gasket 80 along inner diameter wall 84 and bottom wall 82 of annular groove 74. Neoprene external gasket 86 is snugly fit between outer diameter wall 88 of annular groove 74 and outer circumferential surface 160*a* of cylinder 92*a*. The other end of acrylic cylinder 92*a* is placed into annular groove 98 of first intermediary seal 90 in a similar fashion as forward edge 158*a* whereby the acrylic cylinder rear edge 162*a* is contiguous with neoprene bearing gasket 114 along inner diameter wall 110 and bottom wall 106 of annular groove 98 and neoprene external seal 86 is snugly fit between outer diameter wall 118 of annular groove 98 and outer surface 160*a* of acrylic cylinder 92*a*. The second acrylic cylinder 92*b* is placed into rear face annular groove 100 of the first intermediary seal 90 and into the front face annular groove 98*a* of second intermediary seal 90*a*. The third acrylic cylinder 92*c* is placed into annular groove 100*a* of second intermediary seal 90*a* and into the annular groove 134 on front face 136 of rear seal 130**.

A tie-bar unit 170 is utilized to hold the hull in an air and water tight configuration. In this preferred embodiment 10, there are six tie-bar sets, each set comprises of three rods 172, 174, 176 each having both ends threaded to receive a nut or a turnbuckle. All sets are arranged as follows, the first rod 172 has its threaded end 178 introduced into bore 78 through shoulder 76 of forward seal 32. As shown in FIG. 5, once through bore 78, a nut 180 is screwed onto the end 178 to prevent the rod 172 from slipping back through the bore 78. On the other end 182 of the rod 172 is a nut 184 screwed onto the threads. Threaded end 182 is then placed through intermediary seal bore 104 and is received by a turnbuckle 186 which draws the rod 172 through the bore 104 of the intermediary seal 90 and forces nut 184 against shoulder 90. Second rod 174 which is shorter than rods 172, 176, has the front end 188 screwed into the open end of turnbuckle 186. Rear end 190 of rod 174 is then screwed into another turnbuckle 191. Third rod 176 has a nut 194 screwed down on its forward threaded end 192. This threaded end 192 is introduced into second intermediary seal bore **104*a* and is received into the open end of turnbuckle 190. Rear end 196 of third rod 176 is passed through bore 144 of rear seal 130 and a nut 198 is screwed onto the end to be flush against rear face 138 of rear seal 130. To provide air and water tightness, turnbuckles 186, 190 are rotated so as to draw first and third rods 172, 176 towards second rod 174 and in doing so nut 180 forces forward seal 32 onto acrylic cylinder 92*a* into intermediary seal 90. Nut 184 forces intermediary seal 90 onto acrylic cylinder 92*b* and acrylic cylinder 92*b* into intermediary seal 90*a*. Nut 194 forces intermediary seal 90*a* onto acrylic cylinder 92*b* and acrylic cylinder 92*b* into intermediary seal 90. Nut 198 forces rear seal 142 onto acrylic cylinder 92*c* and acrylic cylinder 92*c* into intermediary seal 90*a*. Assembling all six sets of tie-bars in the same fashion provides symmetrical pressure on the seals onto the acrylic cylinders and prevents water leakage into the hull 12**.

Figure 8:
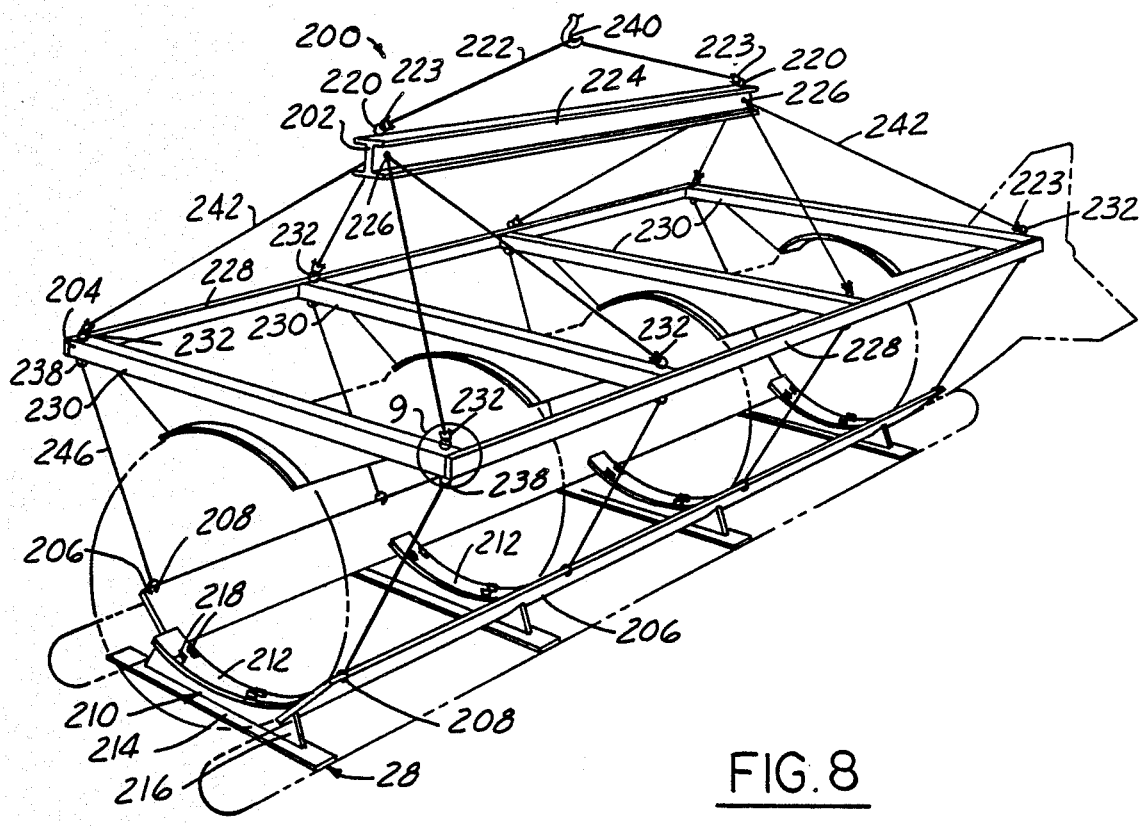
FIG. 8 is a perspective view of a cradle apparatus.

A cradle apparatus 200 as shown in FIG. 8, is necessary to lift hull 12 out of the water. Apparatus 200 comprises a spreader bar 202, an upper cradle frame 204 and a lower integral cradle 28. Integral cradle 28 has a pair of laterally spaced apart and longitudinally extending side rails 206 which extend past forward seal 32, intermediary seals **90, 90*a* and rear seal 130. Side rail 206 has holes 208 which are in the same plane as the seals of the hull. Under each seal is a cross support member 210, which is a modified I-shaped beam having a concave top surface 212 shaped to provide uniform contact to the side of each circular seal. Cross support member 210 has a flat lower surface 214 as the base and an upright or rib 216 which bisects the width of surface 214 and extends up to support concave top surface 212. As shown in FIG. 7, a plurality of clips 218 are welded to the top surface 213 to prevent the seals from moving transversely off of the cross member 210. This lower cradle portion 28 allows the lifting of submersible 10** out of the water without any pressure or force directly acting on any acrylic cylinder or member.

Figure 9:
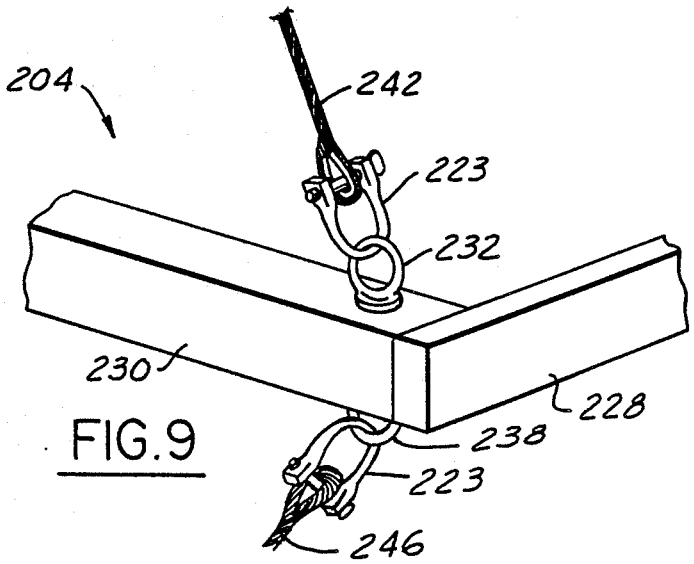
FIG. 9 is a fragmentary and enlarged perspective view of an upper cradle frame of FIG. 8 embodying this invention.

Spreader bar 202 is an I-beam preferably 8 inch and having a length of 22 feet. Two eye bolts 220 are provided, each of which is secured, preferably welded, to opposite ends of the top of spreader bar 202. A steel sling 222 has each thimbled end attached to eye bolts 220 by a shackle 223. Spreader bar 202 has a rib 224 having a pair of holes 226 located on each end of spreader bar 202. Upper cradle frame 204 is made up of 6 inch channel having two sides 228 preferably a length of 25 feet with four cross supports 230 having a length of 90 feet. Cross supports 230 are equal distance from each other and each has a pair of eye bolts 232 welded to the top and a pair of eye bolts 238 welded to the bottom surfaces along the sides 228 (FIG. 9).

To move the submersible 10 from dry dock to the water or vice-a-versa, a crane has its a hook 240 attached to sling 222 on spreader bar 202. Slings 242 are pulled through holes 226 of spreader bar 202 and, as shown in FIG. 9, are attached to eye bolts 232 on the top surface of upper cradle frame 204 by shackles 223. Slings 246 are attached to hooks 238 on the underside of cradle frame 204 and to holes 208 of side rails 206 by shackles 223. All slings 222, 242, 246 are preferably made of ¾ inch plow steel and have thimbled ends to be hooked to shackles 223. The crane raises hook 240 which tensions the slings 242, 246 which act on the side rails and lifts the sub off of the dry dock. The submersible is carefully swung over the water and slowly lowered into the water. Slings 246 are detached from holes 208 in side rails 206 by removing shackles 223 so that the upper cradle frame 204 and spreader bar 202 are returned to over the dock to be removed from the crane.

Boarding the submersible 10 may be made through one of two passages. Hatch 250 located in the ogive unit 14 allows passengers to climb down into the ogive unit 14 and then crawl through aft hatch 156. The preferable method of loading passengers onto submersible 10 is through the front hatch 30. Releasing latch 36 allows front hatch 30 to swing open on hinges 34 and provide an entrance whereby passengers do not have to climb or crawl to reach their seat. Instead passengers can comfortably walk down a center aisle and take their seats. While seated, the only obstruction to a passenger's view may be the narrow steel seals and the traversing tie-rod bar units which hold the hull together. There is no other obstruction to lateral and vertical viewing such as steel ribs or an overhead canopy or roof lining.

From the foregoing description and appended drawings, it will now be apparent that the submersible observation vessel of the present invention provides a safe, comfortable and panoramic view of the ocean environment and provides a watertight and air-tight hull which meets and exceeds the design criteria of the American Bureau of Shipping.

It is also to be understood that the terminology as employed in the description and claims incorporated herein such as "forward", "rear", "upper", "lower", "top", "bottom" etc., is used by way of description and not by way of limitation, to facilitate understanding of the structure, function and operation of the combination of elements which constitute the present invention. Moreover, while the foregoing description and drawings illustrate in detail one successful working embodiment of the my invention, to those skilled in the art to which the present invention relates, the present disclosure will suggest many modifications in construction as well as widely differing embodiments and applications without thereby departing from the spirit and scope of the invention. The present invention, therefore, is intended to be limited only by the scope of the appended claims and the applicable prior art.

What is claimed is:

1. A hull comprising:

(a) first and second encircling end sealing means;

(b) a hatch mounted on and closing one side of said first end sealing means;

(c) a bulkhead mounted on one side of and closing said second end sealing means;

(d) at least one intermediary encircling sealing means; and (e) a plurality of transparent cylinders with peripheral ends interposed between said intermediary sealing means and said first and second end sealing means.

2. The hull set forth in claim 1 further comprising means for joining said first and second end and said intermediary sealing means.

3. The hull set forth in claim 2 wherein said joining means is a tie-bar unit that couples each said sealing means to hold said cylinders between said sealing means into a watertight configuration.

4. The hull as set forth in claim 3 wherein said tie-bar unit comprises:

(a) a plurality of rods with threaded ends;

(b) a plurality of nuts that are received on said threaded ends of said rods and hold said end and intermediary sealing means; and (c) a plurality of turnbuckles that receive said threaded ends and join said rods into said tie-bar unit.

5. The hull as set forth in claim 4 wherein each said end and intermediary sealing means includes a radial shoulder having a plurality of circumferentially spaced bores, each to receive said rod of said tie bar, said nuts abutting said shoulder of said sealing means.

6. The hull as set forth in claim 1 further comprises means for supporting each said sealing means and for lifting the hull.

7. The hull as set forth in claim 6 wherein said supporting means is a cradle comprising:

(a) a pair of laterally spaced apart longitudinally extending side rails;

(b) a plurality of support cross members fixedly attached between said side rails; and (c) a plurality of clips fixedly attached to said support cross members.

8. The hull as set forth in claim 7 wherein said support cross member is a modified I-shaped beam having a flat bottom surface, a concave top surface and an upright rib joining of said bottom surface and said concave top surface.

9. The hull as set forth in claim 8 wherein said clips are attached to said concave top surface of said support cross member to prevent said sealing means from moving transversely of said concave top surface.

10. The hull as set forth in claim 1 wherein said first end sealing means comprises:

(a) a circular band having an inwardly slanted first face clad in monel, a flat second face with an annular groove and a shoulder radially outward of said second face;

(b) a neoprene bearing gasket lining a bottom wall and an inner diameter wall of said annular groove; and (c) a neoprene external gasket adjoining an outer diameter wall of said annular groove.

11. The hull as set forth in claim 1 wherein said second end sealing means comprises:

(a) a circular band having a face with an annular groove and a shoulder radially outward from said face;

(b) a neoprene bearing gasket lining a bottom wall and inner diameter wall of said annular groove; and (c) a neoprene external gasket adjoining an outer diameter wall of said annular groove.

12. The hull as set forth in claim 1 wherein said hatch comprises:

(a) a generally hemispherical shaped transparent member;

(b) a hatch ring that abuts a circumferential edge of said transparent member; and (c) a hold-down ring that releasably attaches to said hatch ring and secures said edge of said transparent member in an airtight abutment with said hatch ring.

13. The hull as set forth in claim 12 wherein said hatch ring is a steel circular band having welded to the perimeter of said ring, a pair of hinges and a latch 180° from said hinges.

14. The hull as set forth in claim 13 wherein said hatch ring is made of steel according to specification ASTM A516 GR. 70.

15. The hull as set forth in claim 12 wherein said hold-down ring is a circular band made of steel according to specification ASTM A516 GR. 70, having an inner circumference with an arcuate shape to uniformly contact outer surface of said transparent member.

16. The hull as set forth in claim 12 wherein said transparent member is made of acrylic $3\frac{1}{2}$ inch thick and has a reference radius of 40.1875 inches and an arc of $121\frac{1}{3}°$.

17. The hull as set forth in claim 16 wherein said acrylic exceeds the minimum physical properties of ASME/ANSI specification PVHO-1.

18. The hull as set forth in claim 1 wherein said intermediary sealing means comprises:

(a) a circular band having a pair of faces each with an annular groove and a shoulder radially outward of said faces;

(b) a neoprene bearing gasket lining a bottom wall and an inner diameter wall of each said annular grooves; and (c) a neoprene external seal adjoining an outer diameter wall of said annular groove.

19. The hull as set forth in claim 1 wherein said transparent cylinders are made up of acrylic exceeding the minimum physical properties of ASME/ANSI specification PVHO-1.

20. The hull as set forth in claim 19 wherein said acrylic cylinders have a length a 90 inches, an inner diameter of $64\frac{1}{2}$ inches and a wall thickness of $3\frac{1}{2}$ inches.

21. A hull comprising:

(a) a forward seal including a circular band having an inwardly slanted first face clad in monel, a flat second face with an annular groove and a shoulder radially outward of said second face, said shoulder having a plurality of bores equally spaced about the circumference, a neoprene bearing gasket lining a bottom wall and inner diameter wall of said annular groove, and a neoprene external gasket adjoining an outer diameter wall of said annular groove;

(b) a hatch hingedly mounted on said forward seal and having a generally hemispherical shaped acrylic member, a hatch ring that abuts a circumferential edge of said acrylic member, a hold-down ring that fixedly attaches to said hatch ring and secures said edge of said acrylic member in an airtight abutment with said hatch ring and a latch to hold said hatch against said forward seal;

(c) a rear seal having a circular band having a forward face with an annular groove and a shoulder radially outward from said face, said shoulder having a plurality of bores equally spaced about the periphery, a neoprene bearing gasket lining a bottom wall and an inner diameter wall of said annular groove, and a neoprene external seal adjoining an outer diameter wall of said annular groove;

(d) an ellipsoid bulkhead fixedly attached to and closing said rear seal;

(e) a plurality of intermediary seals comprising a circular band having a pair of faces each with an annular groove and a shoulder radially outward of said faces, said shoulder having a plurality of bores spaced equally about the circumference, a neoprene bearing gasket lining a bottom wall and inner diameter wall of each said annular grooves, and a neoprene external seal adjoining an outer diameter wall of said annular groove;

(f) a plurality of acrylic cylinders captured between said forward, rear, and intermediary seals, a first cylinder having peripheral edges at one end received in each said annular groove of said forward seal, contiguous with said neoprene bearing gasket along said inner diameter wall and said bottom wall of said annular groove, said neoprene external gasket snugly fit between said outer diameter wall of said annular groove and said first cylinder, said first cylinder having peripheral edges at the other end received in a first intermediary seal, a second cylinder similarly interposed between said first and a second intermediary seals, and a third cylinder similarly interposed between said second intermediary seal and said rear seal;

(g) a tie-bar unit having a plurality of rods with threaded ends to pass through said bores of said seals, a plurality of nuts that screw on said threaded ends of said rods, and a plurality of turnbuckles that join said rods into a single unit; and (h) an integral cradle comprising a pair of laterally spaced apart and longitudinally extending side rails, a plurality of support cross members fixedly attached to said side rails and supporting each said first, second and intermediary seals, and a plurality of clips fixedly attached to said support members to prevent said seals from moving transversely of said cross members.

* * * * *